US010386112B2

(12) United States Patent
Nordieker

(10) Patent No.: US 10,386,112 B2
(45) Date of Patent: Aug. 20, 2019

(54) METHOD AND ASSEMBLY AID TOOL FOR ASSEMBLING A SLIDING DOOR FITTING

(71) Applicant: HETTICH-ONI GMBH & CO. KG, Vlotho (DE)

(72) Inventor: Martin Nordieker, Hülhorst (DE)

(73) Assignee: HETTICH-ONI GMBH & CO. KG, Vlotho (DE)

( * ) Notice: Subject to any disclaimer, the term of this patent is extended or adjusted under 35 U.S.C. 154(b) by 393 days.

(21) Appl. No.: 15/113,173

(22) PCT Filed: Jan. 22, 2015

(86) PCT No.: PCT/EP2015/051218
§ 371 (c)(1),
(2) Date: Jul. 21, 2016

(87) PCT Pub. No.: WO2015/110514
PCT Pub. Date: Jul. 30, 2015

(65) Prior Publication Data

US 2017/0010038 A1 Jan. 12, 2017

(30) Foreign Application Priority Data

Jan. 24, 2014 (DE) ..... 10 2014 100 846

(51) Int. Cl.
*F25D 23/10* (2006.01)
*E05B 17/06* (2006.01)
*F25D 23/02* (2006.01)

(52) U.S. Cl.
CPC ..... *F25D 23/10* (2013.01); *E05B 17/06* (2013.01); *F25D 23/028* (2013.01)

(58) Field of Classification Search
CPC ..... F25D 23/10; F25D 23/028; E05B 17/06
See application file for complete search history.

(56) References Cited

U.S. PATENT DOCUMENTS 1,906,611 A 5/1933 Johnson
2,597,722 A 5/1952 Goldberg
(Continued)

FOREIGN PATENT DOCUMENTS

DE 102012103629 A1 10/2013
EP 0565900 A1 10/1993
(Continued)

OTHER PUBLICATIONS

German Search Report created on Jun. 2, 2014 in related DE Application No. 10 2014 100 846.4.
(Continued)

*Primary Examiner* — Ryan J. Walters
(74) *Attorney, Agent, or Firm* — Patent Portfolio Builders PLLC

(57) ABSTRACT

A method for assembling a sliding door fitting used for coupling an appliance door to a furniture door, which is coupled to a furniture body. The appliance is installed into the furniture body and an assembly aid tool is fixed to the device door. The appliance and furniture doors are closed so that markings are introduced onto an inner surface of the furniture door by pins of the assembly aid tool. The furniture door is opened and the assembly aid tool is released and removed. A base housing of the sliding door fitting is positioned using the markings. The base housing is secured to the furniture door and a slider of the sliding door fitting is fixed to the device door. The assembly aid tool has an angular shape with a first limb and a second limb. The first limb has at least one pin for introducing at least one marking onto the furniture door, and the second limb has a securing opening for fixing the assembly aid tool onto an end face of the device door.

4 Claims, 9 Drawing Sheets

(56) References Cited

U.S. PATENT DOCUMENTS

| | | | | | |
|---|---|---|---|---|---|
| 2,634,507 | A | | 4/1953 | Boatwright | |
| 2,702,224 | A | | 2/1955 | Goldberg | |
| 2,729,895 | A | | 1/1956 | Backstrom | |
| 2,812,589 | A | * | 11/1957 | Wiediger | B25H 7/04 144/27 |
| 3,078,585 | A | | 2/1963 | Dearborn | |
| 3,437,119 | A | * | 4/1969 | Dey | F16B 41/002 411/107 |
| 4,909,012 | A | * | 3/1990 | Thompson, Jr. | E04B 2/702 267/33 |
| 8,789,900 | B2 | | 7/2014 | Laible et al. | |
| 9,228,386 | B2 | | 1/2016 | Thielmann et al. | |
| 2012/0210545 | A1 | * | 8/2012 | Koelling | A43C 15/161 24/595.1 |

FOREIGN PATENT DOCUMENTS

| | | | |
|---|---|---|---|
| EP | 0857929 | A1 | 8/1998 |
| WO | 2006120082 | A1 | 11/2006 |

OTHER PUBLICATIONS

International Search Report dated Apr. 24, 2015 in related International Application No. PCT/EP2015/051218.
Written Opinion dated Apr. 24, 2015 in related International Application No. PCT/EP2015/051218.
Office Action dated Jan. 16, 2019 in related/corresponding EP Application No. 15 701 008.3.

* cited by examiner

Fig. 2
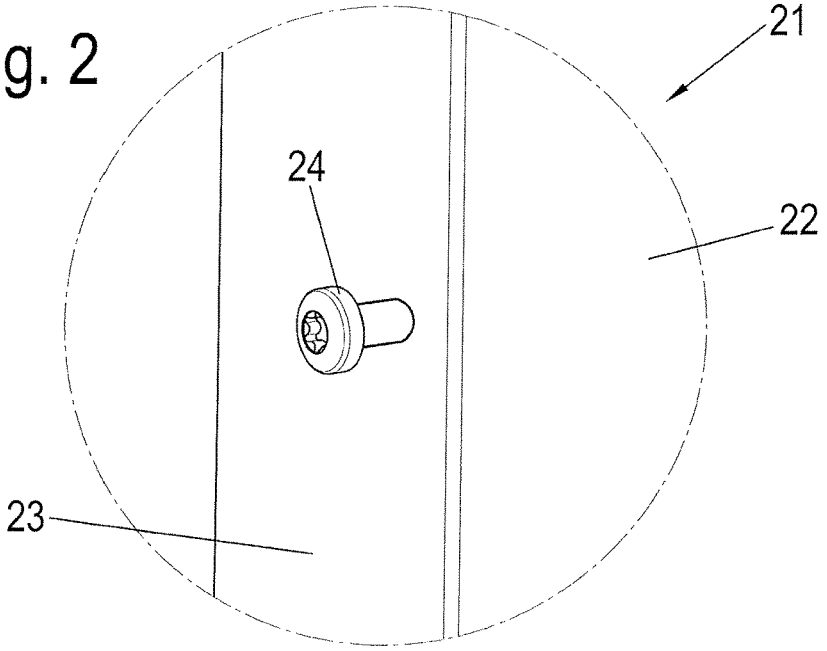
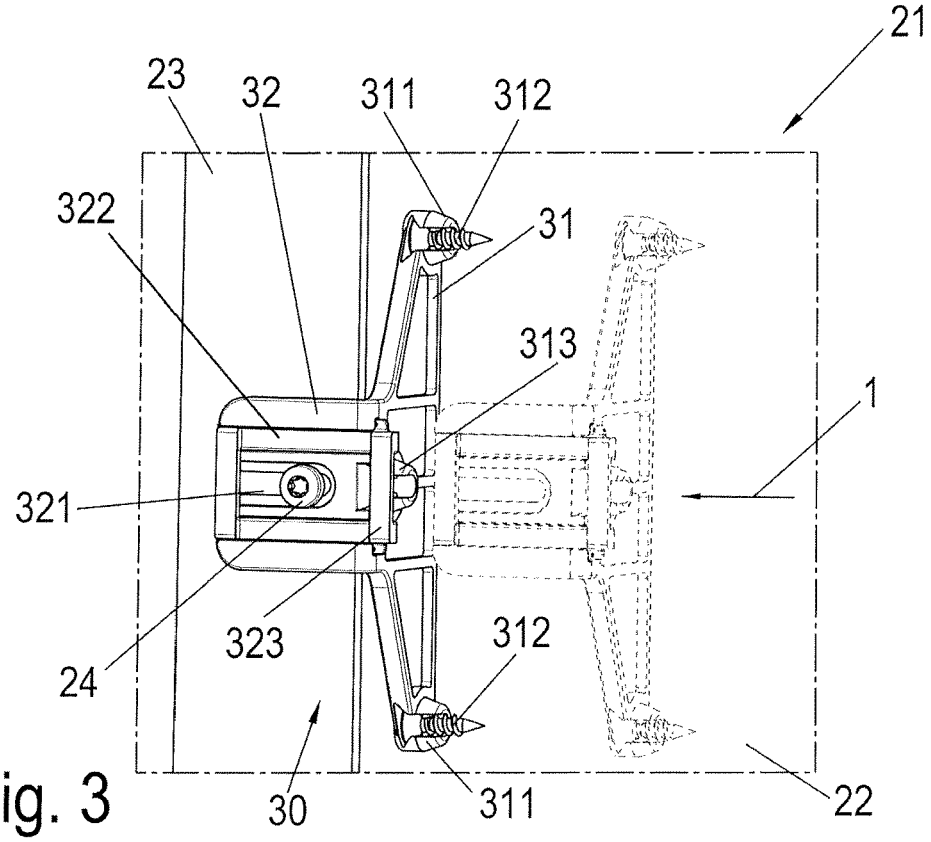
Fig. 3

METHOD AND ASSEMBLY AID TOOL FOR ASSEMBLING A SLIDING DOOR FITTING

BACKGROUND AND SUMMARY OF THE INVENTION

Exemplary embodiments of the invention relate to a method and an assembly aid tool for assembling a sliding door fitting, via which an appliance door of an installed appliance, which is installed in a furniture body, is coupled to a furniture door of the furniture body.

To be able to design a kitchen having uniform furniture fronts, installing installed appliances having a separate appliance door, for example, refrigerators, in a furniture body having a separate door, the furniture door, is known. In this case, both doors typically have different rotational and/or pivot axes. For the sake of convenient operation, both doors are coupled to one another, so that opening and/or closing of the appliance door is performed by moving the furniture door. European patent document EP 0 565 900 A1 disclose a sliding door fitting for this purpose via which the two doors are coupled to one another with regard to their pivot movement, and which compensates for a displacement of the end faces, which are opposite to the hinges, of the two doors, which results from the different rotational and/or pivot axes. The sliding door fitting is fastened on the inner side of the furniture door and on the outer side of the appliance door.

German patent document DE 10 2012 103 629 A1 discloses a sliding door fitting in which, in addition to the function of coupling the two doors, a damping and/or self-retraction function for the doors is integrated. The sliding door fitting has a low structural height, so that it can be arranged in a similar manner as the above-mentioned sliding door fitting between the furniture door and the appliance door. For this purpose, the sliding door fitting has a plate-shaped base housing, and a slide, which is guided in this base housing and is displaceable in relation thereto. The base housing is fastened on the inner side of the furniture door. The slide protrudes out of the base housing in the direction of the free end face of the furniture door, which is opposite to the hinges, and is angled on its end. With this angled end, the slide engages on the free face, i.e., again opposite to the hinges of the installed appliance, of the appliance door and is fixed thereon. The fixing is performed via a screw, which is already preinstalled in the end face of the appliance door. The position of this screw, which can vary, inter alia, in the scope of the available installation range from the positioning of the installed appliance inside the furniture body, determines the fastening position of the base housing of the sliding door fitting on the inner side of the furniture door. However, this position may only be ascertained with the appliance door and furniture door being closed. As a result of the concealed installation of the sliding door fitting, simple holding, marking, and assembly thereof is not possible.

Accordingly, exemplary embodiments of the present invention provide a method and an assembly aid tool for assembling such a sliding door fitting.

A method according to the invention of the type mentioned at the outset has the following steps: after the installed appliance is installed in the furniture body, an assembly aid tool is fixed on the appliance door of the installed appliance. The furniture door is then closed and pressed in, whereby markings are applied to an inner surface of the furniture door by spikes on the assembly aid tool. The furniture door is opened and the assembly aid tool is detached and removed.

A base housing of the sliding door fitting is then position on the basis of the markings and fastened on the furniture door. Finally, a slide of the sliding door fitting is fixed on the appliance door.

In the method according to the invention, an assembly aid tool fixed on the appliance door is therefore used to apply one or more markings on the inner surface of the closed furniture door by way of at least one spike. The marking is thus performed in the closed state of both doors, in which the doors have the correct position in relation to one another for the positioning of the sliding door fitting, but in which the inner surface is not accessible from the outside.

In one preferred embodiment of the method, the assembly aid tool and the slide are fixed on the appliance door using the same fastening means, in particular a preinstalled fastening screw. If the same fastening means is used for the assembly aid tool which is later also used for fixing the slide of the sliding door fitting, the correct positioning of the assembly aid tool is automatically provided.

The assembly aid tool—like the slide of the sliding door fitting—is preferably fixed on an end face of the appliance door. Alternatively, however, fastening can also be performed on the front outer surface, also called the front face, of the installed appliance.

In one preferred embodiment of the method, before the removal of the assembly aid tool, a spacing dimension between the outer surface of the appliance door and the inner surface of the furniture door, with the appliance door and furniture door being closed, is transferred to the assembly aid tool with the aid of a displaceable tab of the assembly aid tool. The spacing dimension, which can only be determined when the doors are closed, is acquired in this manner. Before fixing of the slide of the sliding door fitting, this spacing dimension is then preferably transferred from the assembly aid tool back to the spacing of the doors in relation to one another during the fixing of the slide on the appliance door.

An assembly aid tool according to the invention of the type mentioned at the outset is distinguished in that the assembly aid tool is formed as angled having a first leg and a second leg, wherein the first leg has at least one spike for applying at least one marking to the furniture door, and wherein the second leg has a fastening opening for fixing the assembly aid tool on an end face of the appliance door. The advantages described above in conjunction with the method result.

In one advantageous embodiment of the assembly aid tool, a displaceable tab is formed on the second leg, using which a spacing dimension between the outer surface of the appliance door and the inner surface of the furniture door can be acquired with closed appliance door and closed furniture door. With the aid of the tab, the spacing dimension, which can only be determined with closed doors, can initially be acquired and later transferred again to the position of the doors in relation to one another during the assembly.

In a further advantageous embodiment of the assembly aid tool, the at least one spike is an integral component of the first leg. Alternatively, the first leg can have at least one spike receptacle, in which the at least one spike is removably fixed. In this case, for example, a screw, optionally even the screw used later for fastening the sliding door fitting, can be used as the spike. The at least one spike receptacle is preferably formed as springy, so that the at least one spike can be clipped in.

BRIEF DESCRIPTION OF THE DRAWING FIGURES

The invention will be explained in greater detail hereafter on the basis of figures. In the figures:

FIG. 2 shows a detail view from FIG. 1;

FIG. 3 shows an assembly aid tool attached to the installed appliance in a perspective view;

DETAILED DESCRIPTION

Figure 1:
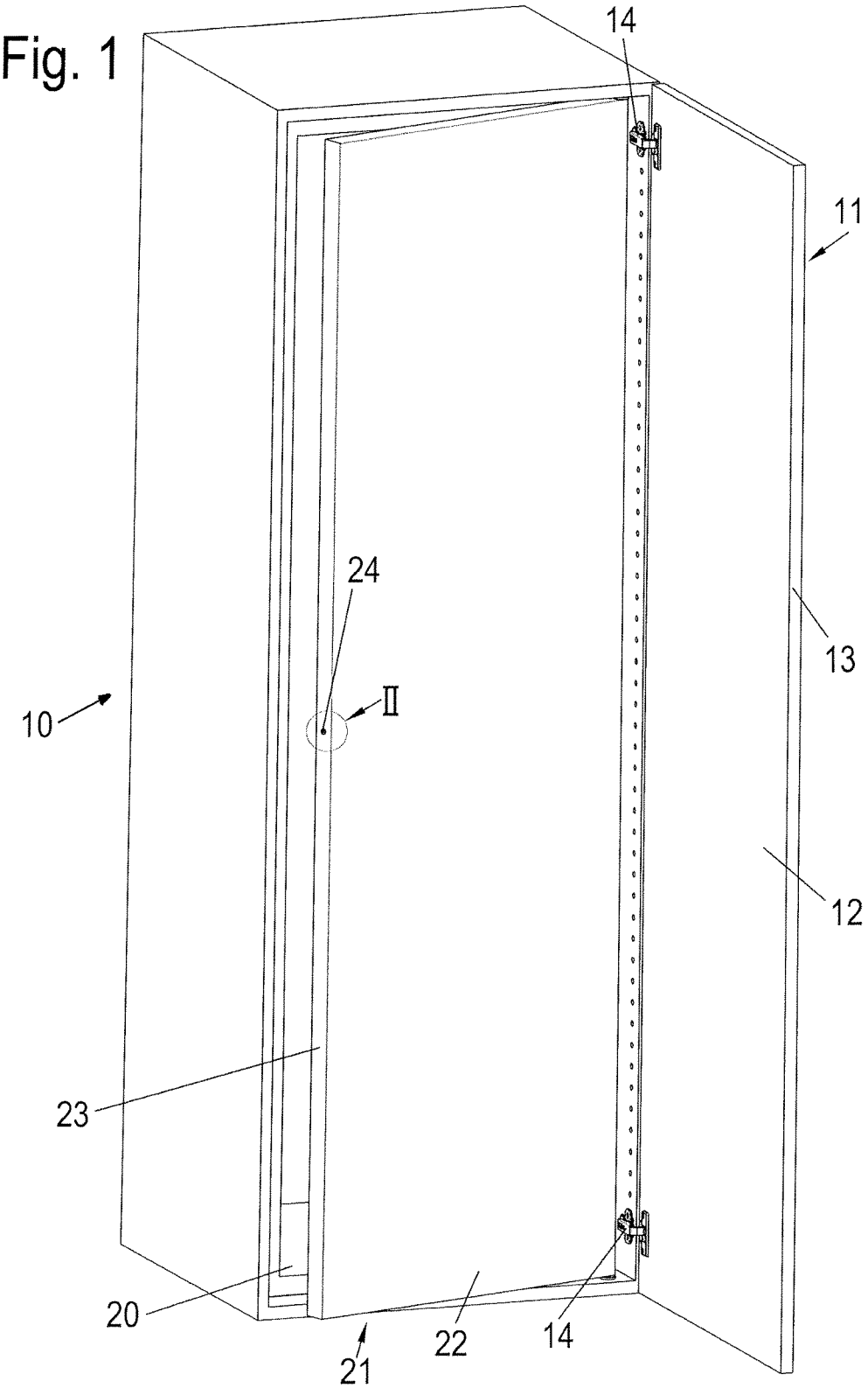
FIG. 1 shows a perspective view of an installed appliance inserted into a furniture body.

FIG. 1 shows a perspective schematic view of a furniture body 10 having an open furniture door 11. The door inner surface 12 and the free, movable end face 13 are visible of the open furniture door 11. The furniture door 11 is fixed so it is pivotable on the furniture body 10 using hinges 14.

An installed appliance 20, for example, a refrigerator or a refrigerator-freezer combination, is installed in the furniture body 10. The installed appliance 20 has an appliance door 21, which is also attached so it is pivotable, and which is shown in a slightly open state in the figure. The appliance door 21 has an outer surface 22, also called the front face, and a free, movable end face 23, which is opposite to the hinges (not visible) of the installed appliance 20 in this figure.

With regard to height, a preinstalled fastening screw 24 is screwed in approximately in the middle region of the free end face 23 of the appliance door 21. The fastening screw is used for fixing a part, for example, a slide, of a sliding door fitting to be installed. This screw can be, for example, a flow-form screw, which has embossed a thread in the appliance door 21 during the pre-installation. However, it can also be provided that a self-tapping sheet-metal screw is used as the fastening screw 24. Alternatively, a nut or threaded plate, which is fixedly connected, for example, welded, to the appliance door 21, can be arranged in the interior of the appliance door 21, so that a screw having machine thread can be used as the fastening screw 24. Furthermore, not only fastening with the aid of an additional, separate fastening means such as the mentioned fastening screw 24 is possible, but rather also fastening with the aid of recesses or protrusions on the appliance door 21, which enable direct fastening, for example, a snap connection, of a correspondingly designed part of the sliding door fitting to the appliance door 21.

It is even possible, with appropriate structural design of the sliding door fitting, or of the part of the sliding door fitting to be connected to the appliance door, to displace the fastening point to the outer surface 22 (front face) of the appliance door 21. In comparison to a fastening point provided on the end face 23 of the appliance door 21, which faces toward the user and is therefore visible, a fastening point provided on the front face can make the cleaning option of the end face 23 easier.

The region of the fastening screw 24 is shown once again in the enlargement in FIG. 2.

To achieve coupling of the furniture door 11 and the appliance door 21, a sliding door fitting is installed between the two doors 11, 21, which preferably not only couples the movement of the two doors 11, 21, but rather also offers a damping and/or self-retraction function for the doors 11, 21. The sliding door fitting is fastened using a base housing on the inner surface 12 of the furniture door 11 and has an angled slide, which rests with one angled section on the end face 23 of the appliance door 21 and is fixed thereon by the fastening screw 24. A method for installing such a sliding door fitting is explained and an assembly aid tool used in the scope of this method is described in conjunction with the following figures.

FIG. 3 shows such an assembly aid tool 30, which is attached to the appliance door 21 and fixed with the aid of the assembly screw 24. The assembly aid tool 30 is formed as angled with respect to its basic design, having a first leg 31, which rests in the position shown on the outer surface 22 of the appliance door 21. This first leg is therefore designated hereafter as the surface leg 31. The assembly aid tool 30 has a second leg 32, which is aligned perpendicularly to the surface leg 31 and rests on the free end face 23 of the appliance door 21. This second leg is therefore designated hereafter as the end face leg 32.

The surface leg 31 is designed as approximately trapezoidal, so that cantilevers pointing outward—upward and downward in the position shown—are formed. Spike receptacles 311 are formed onto the end of the cantilevers, into each of which one spike 312 is inserted. The spike receptacles 311 are preferably embodied so that the spike 312 is easily insertable and removable and at the same time is held without play if possible in the spike receptacle 311. The spike receptacles 311 are designed as c-shaped, for example, so that the spike 312 can be clipped in laterally.

In the illustrated example, a self-tapping wood screw having pronounced tip is used in each case as the spike 312. However, a spike manufactured especially for this purpose can alternatively also be used. In a further alternative embodiment, it is conceivable to provide a spike which is fixedly connected to the assembly aid tool 30 instead of a spike receptacle.

The assembly aid tool 30 is preferably produced from plastic in an injection molding method. If permanently integrated spikes are used, a plastic body can be injection molded onto corresponding spikes.

In addition, arranging further spike receptacles 313 on the surface leg 31 can additionally be provided, which are not relevant for the example shown here, but are usable in conjunction with other embodiments of a sliding door fitting. Thus, for example, by attaching the assembly aid tool 30 in another height position on the appliance door 21 with insertion of a spike 312 into the spike receptacle 313, a marking can be created for the fastening of a slide rail having central fastening point (not shown in the figures) in the height on the furniture door 11.

A fastening slot 321, which is open toward the free side of the end face leg 32, is introduced into the end face leg 32. The assembly aid tool 30 can be pushed under the screw head of the fastening screw 24 using the fastening slot 321. This movement is shown in FIG. 3 by the movement arrow 1. When the surface leg 31 rests flatly on the appliance door 21, the assembly aid tool 30 is fixed on the appliance door 21 by tightening the fastening screw 24. The spikes 312 are then positioned at a position, which is fixed by the geometry of the assembly aid tool 30 and is specified with regard to the sliding door fitting used, on the outer surface 22 of the appliance door 21, wherein this position is determined in relation to the position of the fastening screw 24.

Furthermore, a tab 322 is displaceably fixed on the end face leg 32 of the assembly aid tool 30. The tab 322 can be displaced in parallel to the surface of the end face leg 32 and therefore perpendicularly to the surface of the surface leg 31. In FIG. 3, the tab 322 is shown in a retracted position, in which a stop 323 of the tab 322, which is located on the right in the figure, protrudes only slightly beyond the surface leg 31.

Figure 4:
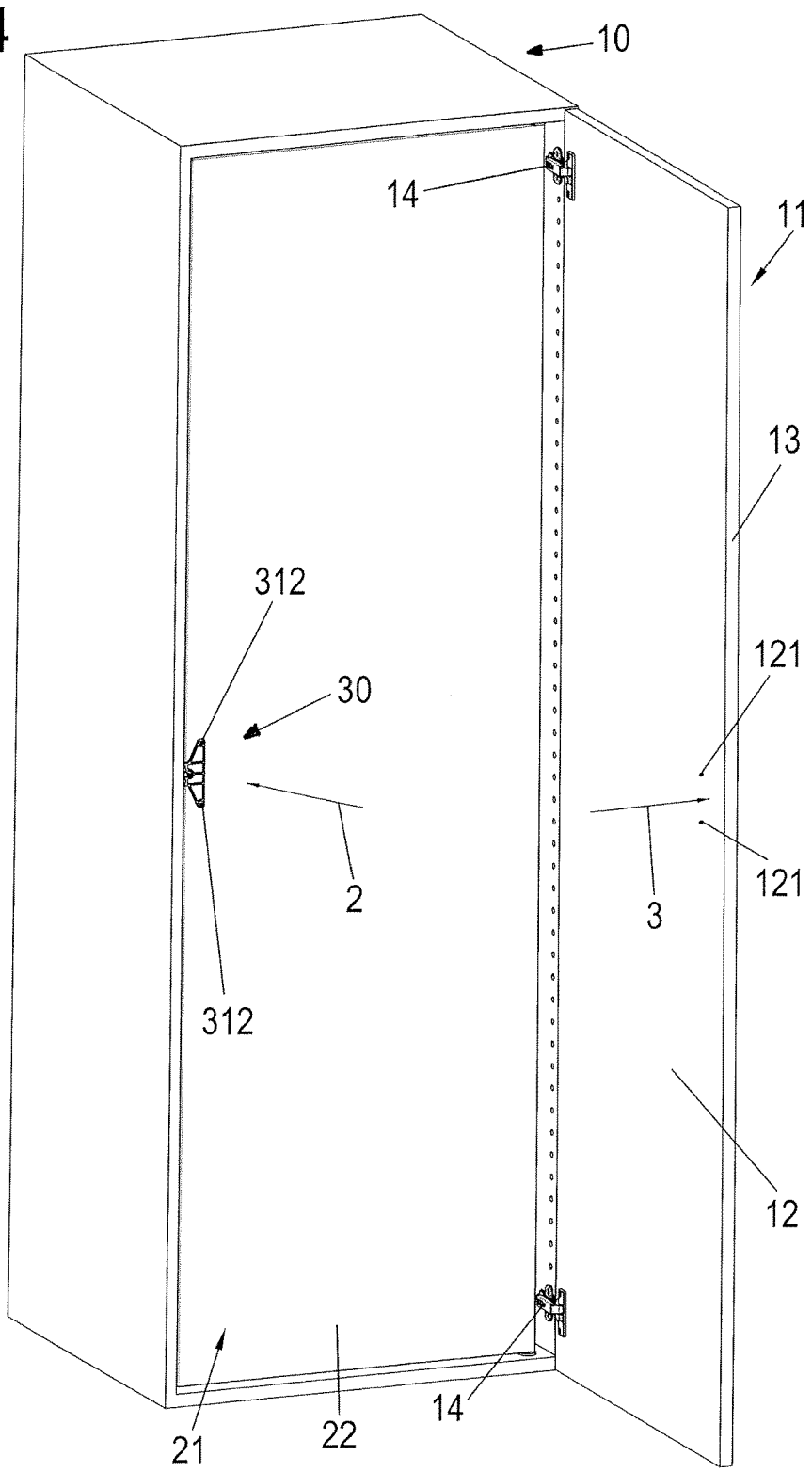
FIG. 4 shows a view similar to FIG. 1 with attached assembly aid tool.

FIG. 4 shows the furniture body 10 with inserted appliance 20 and applied assembly aid tool 30 in the same perspective as FIG. 1. As indicated by a movement arrow 2, as a next step in the assembly process, first the appliance door 21 is closed and then the furniture door 11 is also moved into a closed position and pressed in enough that the tips of the spikes 312 penetrate into the inner surface 12 of the furniture door 11. After the furniture door 11 is opened again, which is symbolized by the movement arrow 3, the spikes 312 have left markings 121 on the inner surface 12 of the furniture door 11 with their tips.

Figure 5:
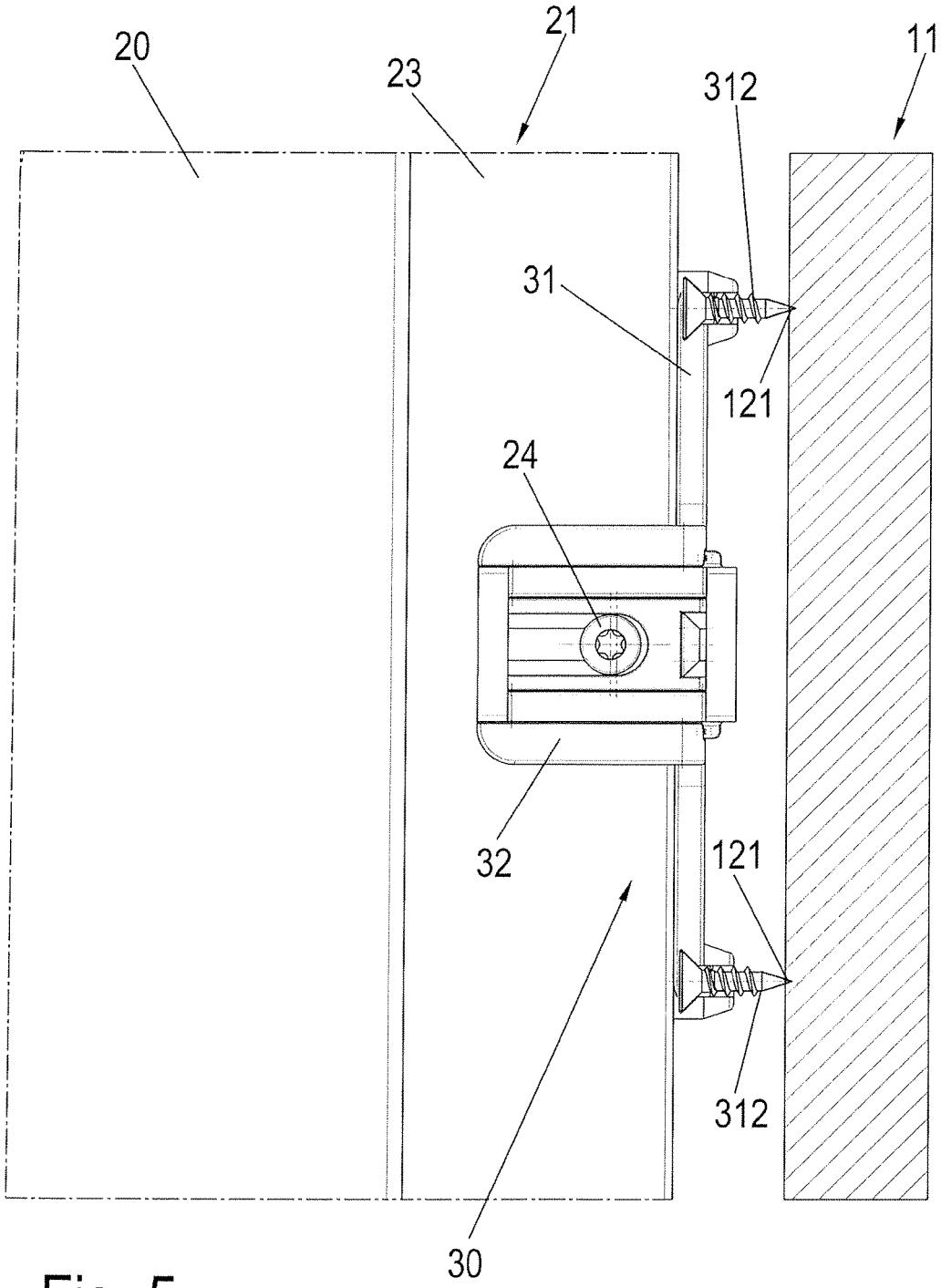
FIG. 5 shows a side view of the attached assembly aid tool of FIG. 4.

The process of pressing the spikes 312 into the furniture door 11 is shown once again in a sectional illustration in FIG. 5, wherein the illustrated plane of section extends in parallel to the end face 23 of the appliance door 21.

Figure 6:
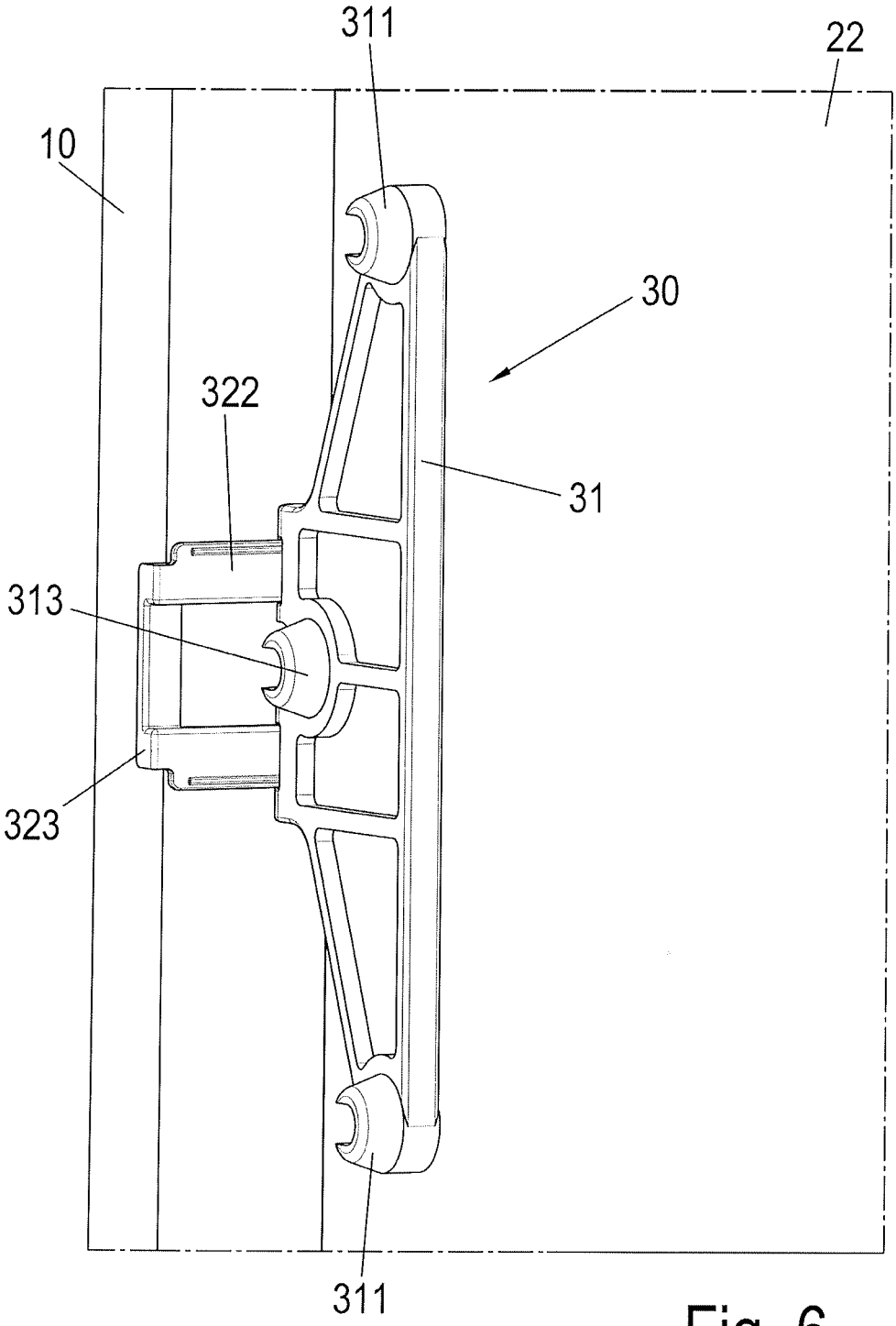
FIG. 6 shows a perspective view of an assembly aid tool with extended tab.

In a next assembly step, the spikes 312 are removed from the spike receptacles 311. The tab 322 of the assembly aid tool 30 is then extended, so that when the appliance door 21 is closed, it protrudes beyond the stop edge of the furniture body 10, on which the furniture door 11 stops. This is shown in FIG. 6 in a perspective illustration.

The furniture door 11 is thereupon closed, so that its inner surface 12 stops against the stop 323 of the extended tab 322 and pushes it in in the direction of the furniture body 10 until reaching the completely closed position of the furniture door 11.

Figure 7:
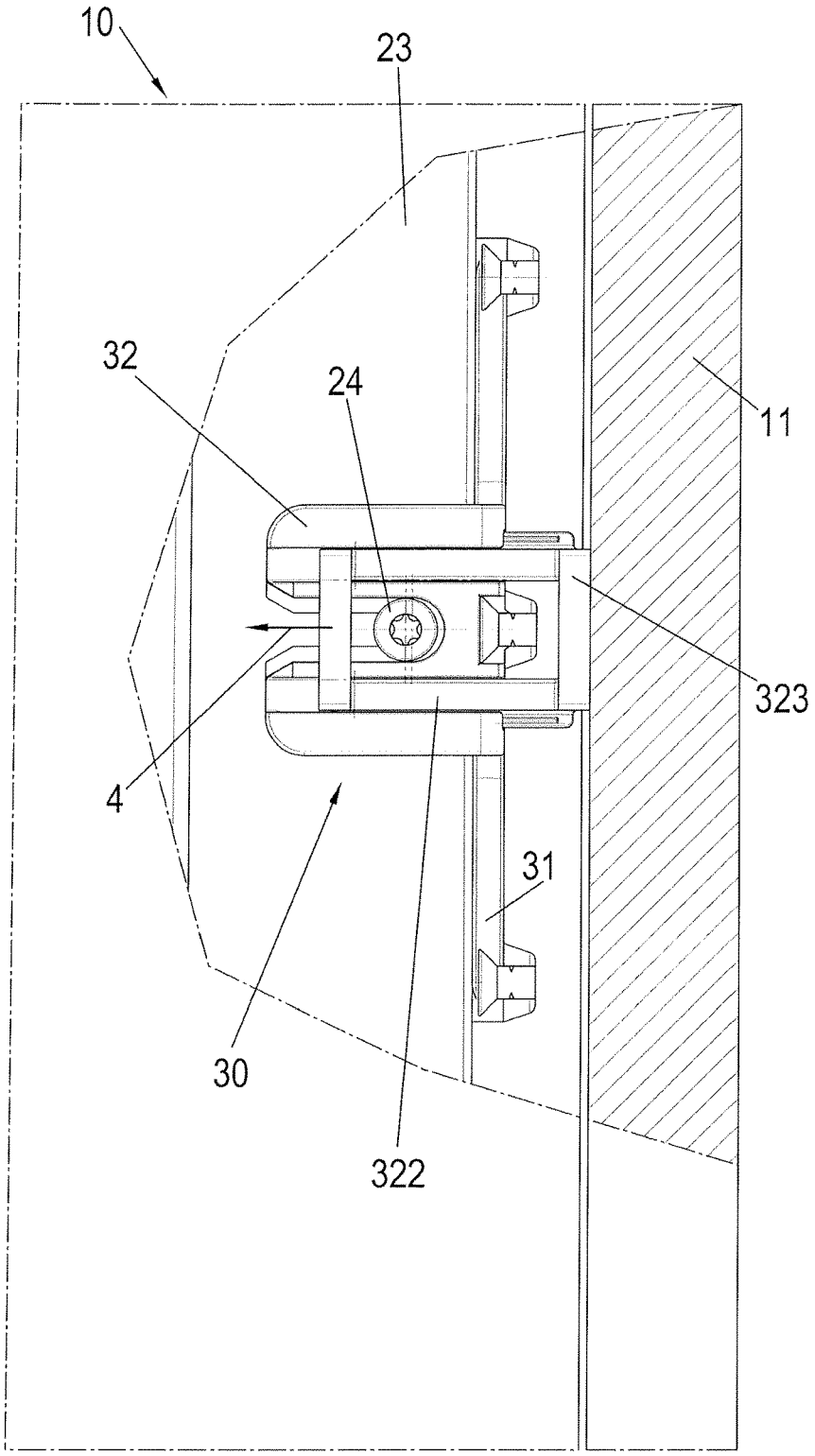
FIG. 7 shows a side view in partial section of the assembly aid tool, which is fixed on the appliance door, with closed furniture door for spacing dimension determination.

The final position reached by the tab 322 is shown in FIG. 7. The movement arrow 4 symbolizes the movement of the tab 322. The tab 322 is guided in the assembly aid tool 30 such that it may be displaced with acceptable application of force, wherein it maintains its displaced position in relation to the legs 31, 32 of the assembly aid tool 30 without greater force action, however. A spacing dimension d has therefore resulted from the contact surface of the surface leg 31 up to the outer edge of the stop 323, which reflects the correct spacing between the outer surface 22 of the appliance door 21 and the inner surface 12 of the furniture door 11 in the closed state of the furniture door 11 and the appliance door 21. The assembly aid tool 30 is now removed after opening the doors 11, 21 and after loosening and/or unscrewing the fastening screw 24, without the tab 322 being displaced.

Figure 8:
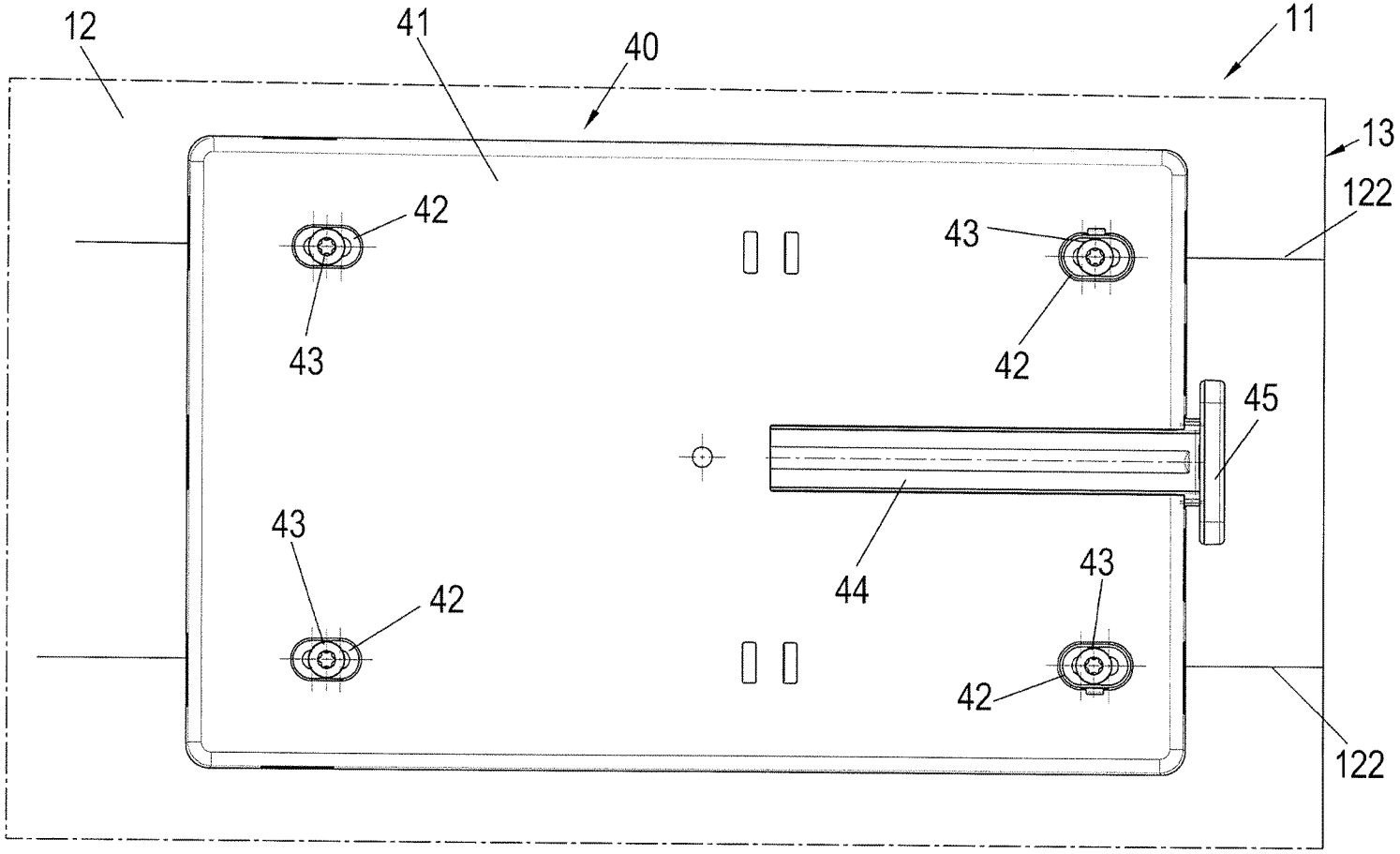
FIG. 8 shows a top view of a furniture door with fixed sliding door fitting.
Figure 9:
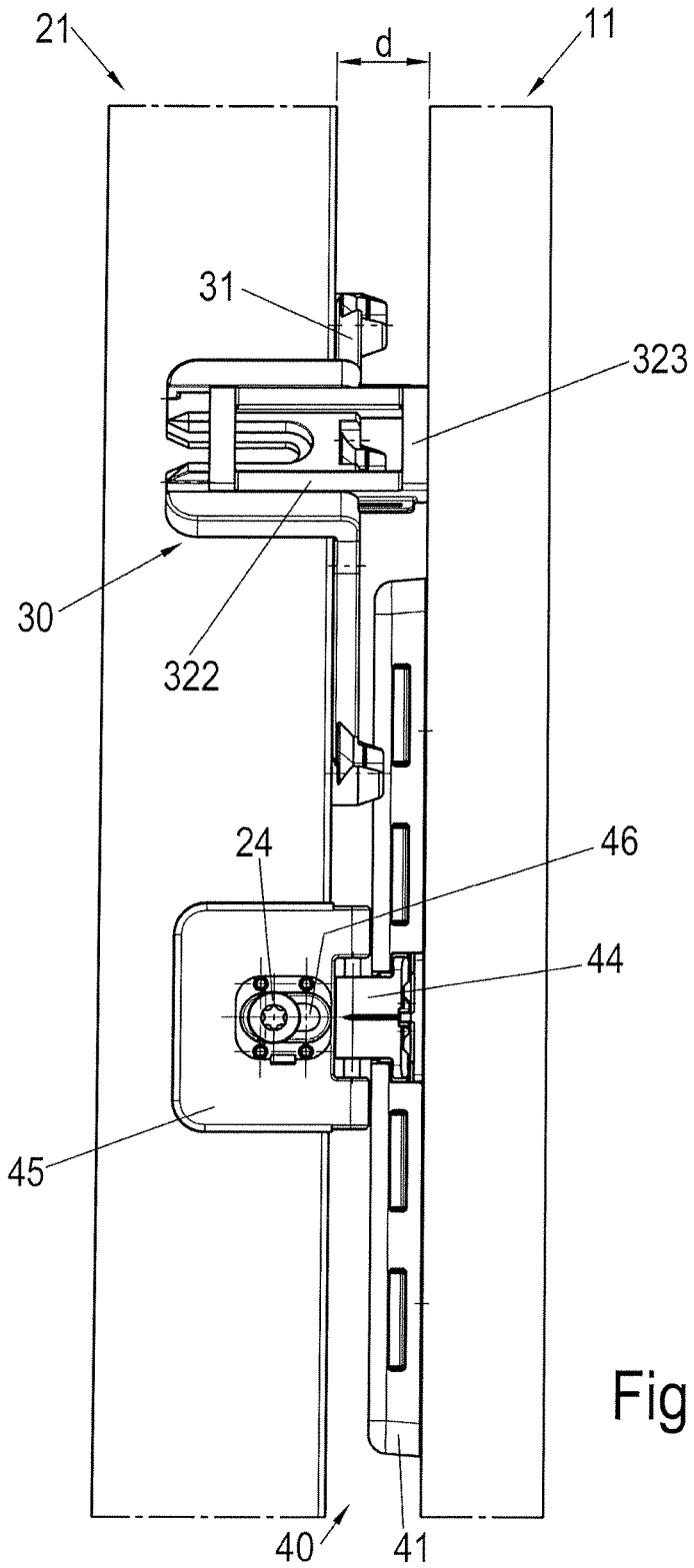
FIG. 9 shows a side view of the appliance door and/or furniture door during the fixing of the sliding door fitting on the appliance door.

In a further assembly step, the markings 121 are used to position a sliding door fitting 40 on the furniture door 11. This is shown in FIG. 8. The sliding door fitting 40 has a base housing 41, which has four fastening holes 42 for screws 43 in the present case. The sliding door fitting 40 furthermore comprises a slide 44 having a head part 45 designed as an angled section.

The markings 121 identify the positions of the screws 43 used for fastening the base housing 41 (in FIG. 8, the two screws located in the right half of the sliding door fitting 40). To find the position of the other two fastening screws, drawing auxiliary lines 122, which extend perpendicularly to the end face 13, through the markings 121 and drawing on markings for the further screws 43 on the basis of the spacing of the fastening holes 42 can optionally be provided.

The base housing 41 of the sliding door fitting 40 is then screwed tightly onto the furniture door 11 with the aid of the fastening screws 43. Self-tapping screws can be used as the screws 43. It can optionally be provided that assembly holes are predrilled at the markings 121 and/or the further marked positions in the furniture door 11. Two of the screws 43 can be the two designated screws used as the spikes 312.

In a further assembly step, the head part 45 of the slide 44 of the sliding door 40 is then laid on the free end face 23 of the appliance door 21 in a partially or entirely open position of the furniture door 11 and the appliance door 21.

In this case, the assembly aid tool 30 is held partially between the appliance door 21 and the furniture door 11 such that the contact side of a cantilever of the surface leg 31 rests on the outer surface 22 of the appliance door 21 and the furniture door 11 presses against the stop 323 of the assembly aid tool 30. In this manner, the previously acquired spacing dimension d is transferred to the position of the doors 11, 21 in relation to one another. In this position of the doors 11 and 21, the fastening screw 24 is then guided through an oblong hole 46 provided in the head part 45 and screwed back into the appliance door 21.

Figure 10:
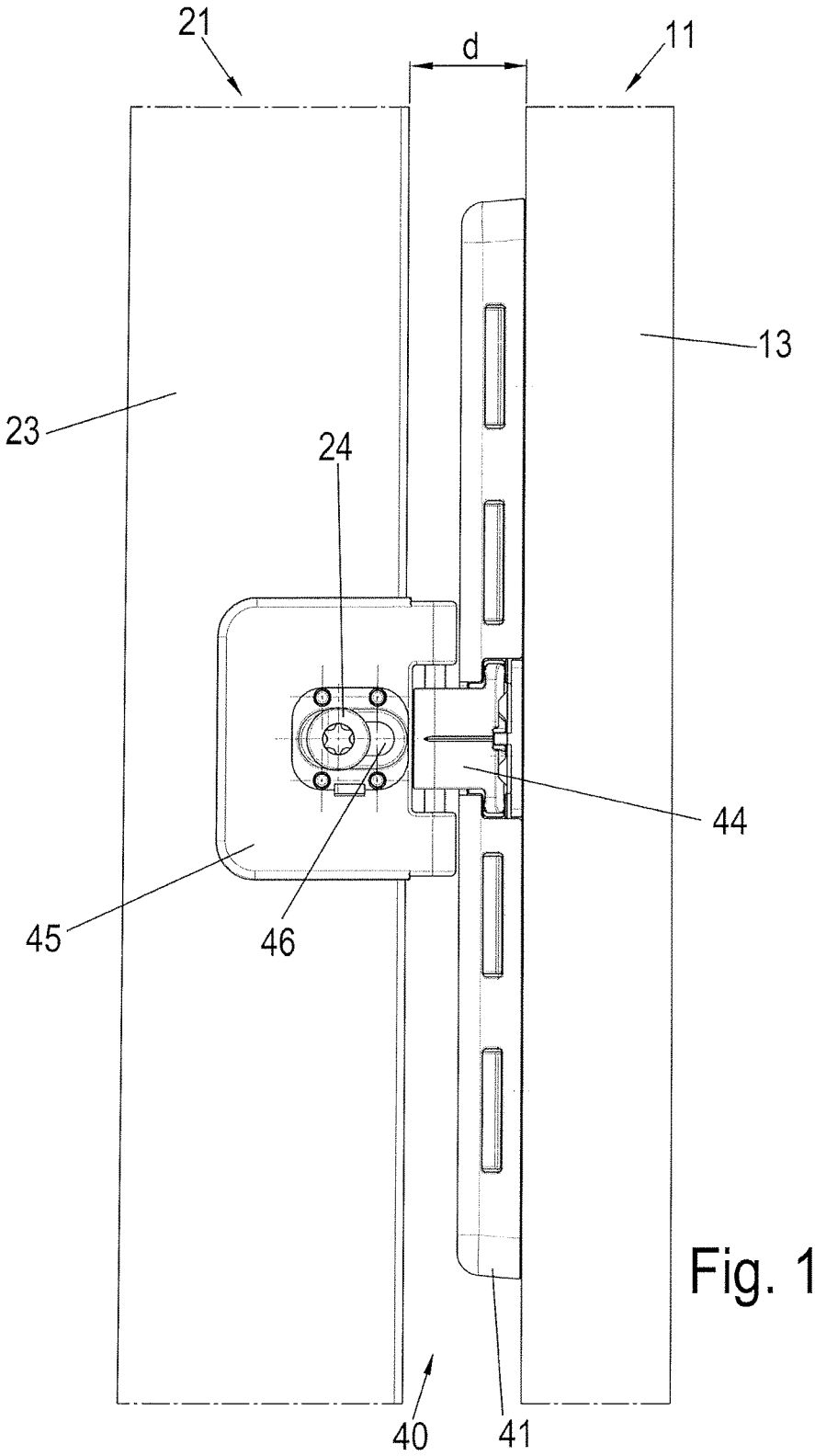
FIG. 10 shows a side view of furniture door and appliance door with fully-assembled sliding door fitting.

By tightening the fastening screw 24, the head part 45 of the sliding door fitting 40 is fixed on the free end face 23 of the appliance door 21. The assembly aid tool 30, which is held between the two doors 11, 21 to set the spacing dimension d, is now removed, whereupon the assembly of the sliding door fitting 40 is finished. FIG. 10 shows the two doors 11, 21 with the fully-assembled sliding door fitting 40 once again in a side view.

Although the present invention has been described above by means of embodiments with reference to the enclosed drawings, it is understood that various changes and developments can be implemented without leaving the scope of the present invention, as it is defined in the enclosed claims.

The invention claimed is:

1. An assembly aid tool for assembling a sliding door fitting, via which an appliance door of an installed appliance installed in a furniture body is coupled to a furniture door of the furniture body, the assembly aid tool comprising:

a first leg; and a second leg arranged at an angle to the first leg, wherein the first leg has at least one spike for applying at least one marking to the furniture door, wherein the second leg has a fastening opening for fixing the assembly aid tool on an end face of the appliance door, wherein a displaceable tab is formed on the second leg, using which a spacing dimension between an outer surface of the appliance door and an inner surface of the furniture door can be acquired with appliance and furniture doors closed, wherein the first leg has at least one spike receptacle, in which the at least one spike is removably fixed, and wherein the at least one spike receptacle is c-shaped so that the at least one spike can be clipped in laterally.

2. The assembly aid tool of claim 1, wherein the at least one spike receptacle is springy so that the at least one spike can be clipped in.

3. The assembly aid tool of claim 1, wherein the second leg includes at least one spike receptacle, in which an additional spike is removably fixed, and wherein the at least one spike receptacle of the second leg is c-shaped so that the additional spike can be clipped in laterally.

4. The assembly aid tool of claim 1, wherein the at least one spike is a screw, and wherein the at least one spike receptacle has a first portion configured to accommodate a head of the screw and a second portion configured to accommodate threads of the screw.

* * * * *